US005631519A

United States Patent [19]

Kim

[11] Patent Number: 5,631,519

[45] Date of Patent: May 20, 1997

[54] FIELD EMISSION MICRO-TIP

[75] Inventor: Jong-min Kim, Seoul, Rep. of Korea

[73] Assignee: Samsung Display Devices Co., Ltd., Suwon, Rep. of Korea

[21] Appl. No.: 509,057

[22] Filed: Jul. 31, 1995

[30] Foreign Application Priority Data

Mar. 29, 1995 [KR] Rep. of Korea ..... 95-6888

[51] Int. Cl.[6] ..... H01J 1/02; H01J 9/02

[52] U.S. Cl. ..... 313/336; 313/309; 313/351; 445/24; 445/50

[58] Field of Search ..... 313/309, 336, 313/351; 445/24, 49, 50

[56] References Cited

U.S. PATENT DOCUMENTS 5,090,932 2/1992 Dieumegard et al. ..... 445/24
5,148,079 9/1992 Kado et al. ..... 313/309
5,382,867 1/1995 Maruo et al. ..... 313/309
5,386,172 1/1995 Komatsu ..... 313/309
5,457,355 10/1995 Fleming et al. ..... 313/336

*Primary Examiner*—Michael Horabik
*Assistant Examiner*—Michael Day
*Attorney, Agent, or Firm*—Foley & Lardner

[57] ABSTRACT

A field emission device has a rear substrate (11), a titanium or aluminum adhesive layer (12) and disposed on the substrate (11), a tungsten cathode (13) disposed on the adhesive layer (12), a micro-tip (13') protruding from the cathode (13), a titanium or aluminum mask layer (14) disposed on the cathode (13), and a metal pattern (15) formed on the mask layer (14) for supporting the cathode (13). The micro-tip (13') is formed by the simultaneous etching of the tungsten cathode (13), the adhesive layer (12), and the mask layer (14') resulting in a large internal stress in the micro-tip (13'). The residual internal stress in the micro-tip (13') results in the micro-tip (13') curving away from the substrate (11) which, consequently, facilitates electron emission.

10 Claims, 3 Drawing Sheets

FIELD EMISSION MICRO-TIP

BACKGROUND OF THE INVENTION

The present invention relates to a field emission micro-tip which can emit electrons uniformly and can be fabricated at a high yield when applied to a large device.

As an image display device to replace the cathode ray tube of existing television receivers, flat panel displays have been under vigorous development for use as in wall-mounted (tapestry) televisions and high definition televisions (HDTV).

Such flat panel displays include plasma display panels, liquid crystal displays, and field emission displays. Among these, the field emission display is widely used owing to the quality of its screen brightness and low power consumption.

Referring to FIG. 1, the structure of a conventional vertical field emission micro-tip will now be described.

The vertical field emission micro-tip includes a glass substrate 1, a cathode 2 formed on the glass substrate 1, a micro-tip 4 for field emission formed on cathode 2, an insulating layer 3 formed glass substrate 1 having a hole 3' surrounding micro-tip 4 on cathode 2, and a gate layer 5 formed on insulating layer 3 having an aperture 5' to allow field emission from micro-tip 4.

FIG. 2A is a vertical cross-section of a conventional horizontal field emission micro-tip and FIG. 2B is a plan view of the horizontal field emission micro-tip shown in FIG. 2A. As shown, in contrast with the vertical field emission micro-tip shown in FIG. 1, the structure of the horizontal field emission micro-tip has a cathode 10 and an anode 8 which are horizontally formed above a substrate 6 so that electrons are emitted horizontally with respect to the substrate 6.

The structure of the horizontal field emission micro-tip will now be described in detail.

An insulating layer 7 is formed on a glass substrate 6. A cathode 10 and an anode 8 are deposited on insulating layer 7 with a predetermined spacing. A hole 7' is formed on the insulating layer 7 between cathode 10 and anode 8 to a predetermined depth. A gate electrode 9 is provided within hole 7' to control electron emission from cathode 10 to anode 8.

In the case of vertical field emission micro-tip using a single tip as shown in FIG. 1, since the flow of electron beams depends on the size of gate aperture 5' a fabrication technique applicable to a micro-tip with several tens of nanometers in diameter is desired. In other words, in order to fabricate a high-precision gate aperture for the vertical field emission micro-tip of several tens of nanometers, a highly advanced microfabrication technique of submicron units is necessary. Thus, there are problems such as non-uniformity throughout the fabrication process and a lowered yield when fabricating larger devices. Also, if the gate aperture is larger, a higher level of bias voltage must be applied to the gate, thereby necessitating a higher voltage for driving the device.

The horizontal field emission micro-tip shown in FIG. 2A has a higher yield and a more uniform structure, compared with the vertical field emission micro-tip. However, variable application of the horizontal field emission micro-tip is difficult, since the flow of electrons is restricted to a single horizontal direction. As a result electron beam application using the horizontal field emission micro-tip is very difficult.

SUMMARY OF THE INVENTION

In order to solve the aforementioned problems, it is an object of the present invention to provide a field emission micro-tip which can emit electrons uniformly and can be fabricated at a high yield when applied to a large device.

To accomplish the above object, the field emission micro-tip according to the present invention comprises: a substrate; an adhesive layer formed on a part of the substrate; a cathode formed on the adhesive layer; a micro-tip formed by a predetermined portion of the cathode and being upwardly protruded; a mask formed on the cathode except atop the micro-tip region; and a metal pattern formed on the mask, for supporting the cathode.

In the present invention, the adhesive layer and the mask are preferably formed of titanium or aluminum. The cathode is preferably formed of tungsten. The micro-tip preferably has a triangular peak which is upwardly protruded at a protrusion angle of 60° to 70°. The metal pattern is preferably formed by depositing chrome.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
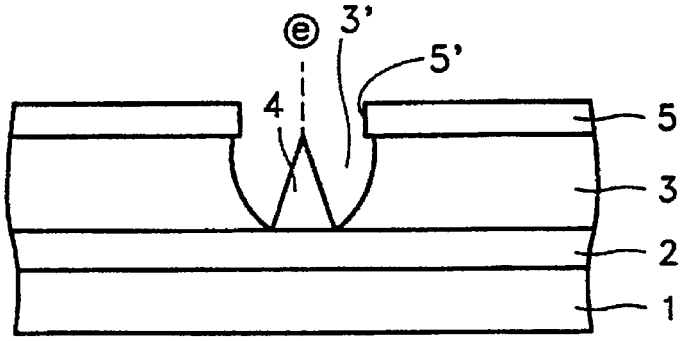
FIG.1 (PRIOR ART)
FIG. 1 is a vertical cross-section of a conventional vertical field emission micro-tip.
Figure 2A:
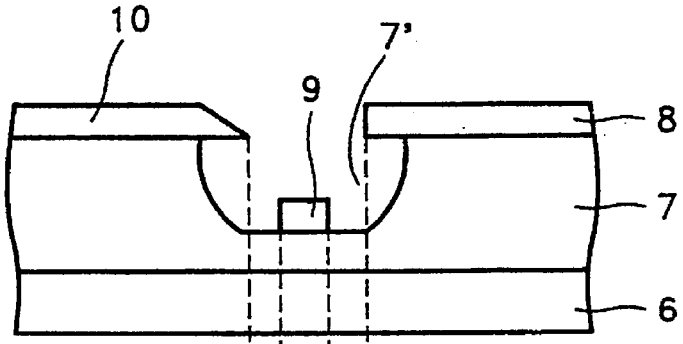
FIG.2A (PRIOR ART)
FIGS. 2A and 2B are a vertical cross-section and a plan view of a conventional horizontal field emission micro-tip, respectively.
Figure 2B:
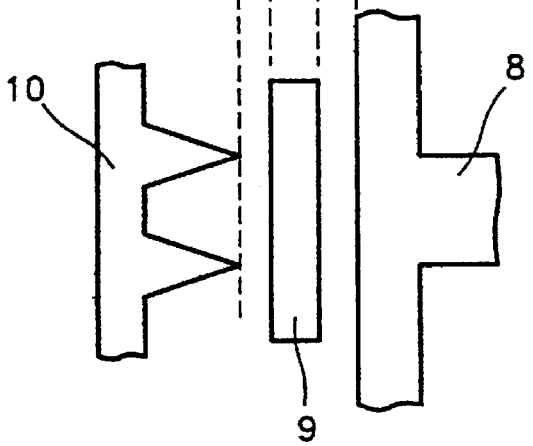
FIG.2B (PRIOR ART)
Figure 3:
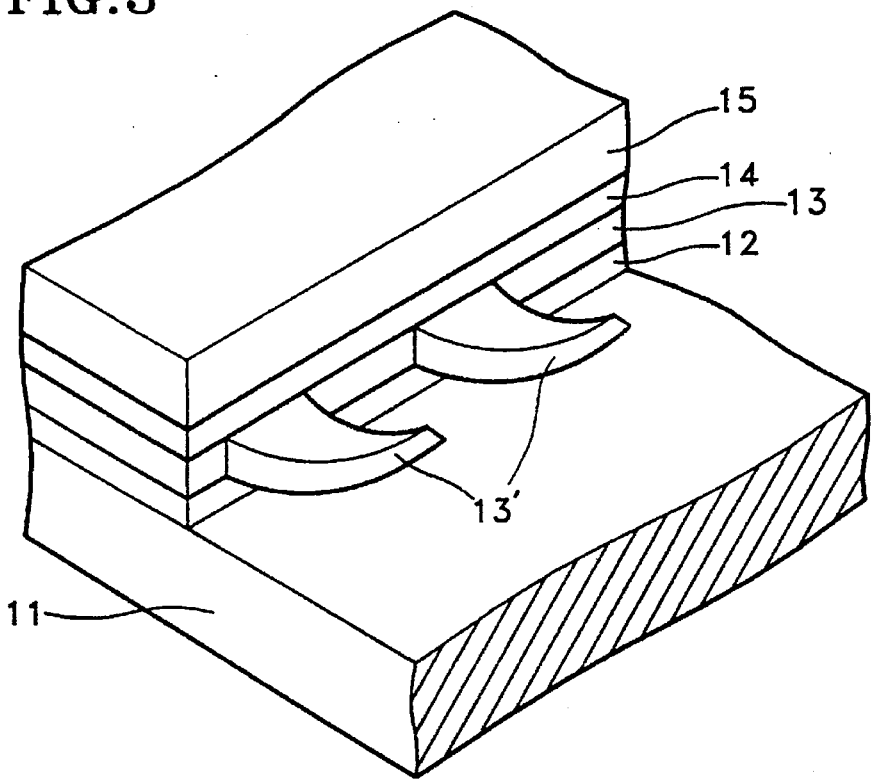
FIG. 3 is a perspective view of a field emission micro-tip according to the present invention.

Referring to FIG. 3, the structure of the field emission micro-tip according to the present invention will be first described.

The field emission micro-tip according to the present invention is structured such that an adhesive layer 12, a cathode 13 and a micro-tip 13', a mask layer 14, and a cathode supporting layer 15 are sequentially deposited on a glass substrate 11. Here, adhesive layer 12 is formed by depositing either titanium or aluminum to a thickness of 2,000 Å. Cathode 13 is formed by depositing tungsten to a thickness of 1 μm. Micro-tip 13' is formed by patterning cathode 13 partially in a triangular shape protruding upwardly by an angle of 60°~70°. Mask layer 14 is formed by depositing either titanium (Ti) or aluminum (Al) to a thickness of 1,000 Å, and then patterning in a similar shape to adhesive layer 12. Cathode supporting layer 15 is formed by depositing chrome (Cr) and patterning in stripe. Here, adhesive layer 12 and mask layer 14 are formed by selecting a pair from the group consisting of pairs of Ti and Al, Al and Ti, Al and Al, and Ti and Ti. Among these pairs, the pair of Ti and Al is the most preferable for the adhesive and mask layers. Tungsten (W) which is the cathode material between the selected pair has strong internal stress compared with the selected pair.

The selected pair, Ti and Al, are etched very rapidly, while tungsten is not etched. Thus, micro-tip 13' is formed by the severe differences in the etching rate and internal stress of the cathode, the adhesive layer and the mask layer. In other words, the microtip 13' patterned in a triangular shape is formed to protrude upwardly as a result of the due strong internal stress of tungsten when adhesive layer 12 and mask 14 are instantaneously etched off.

Figure 5:
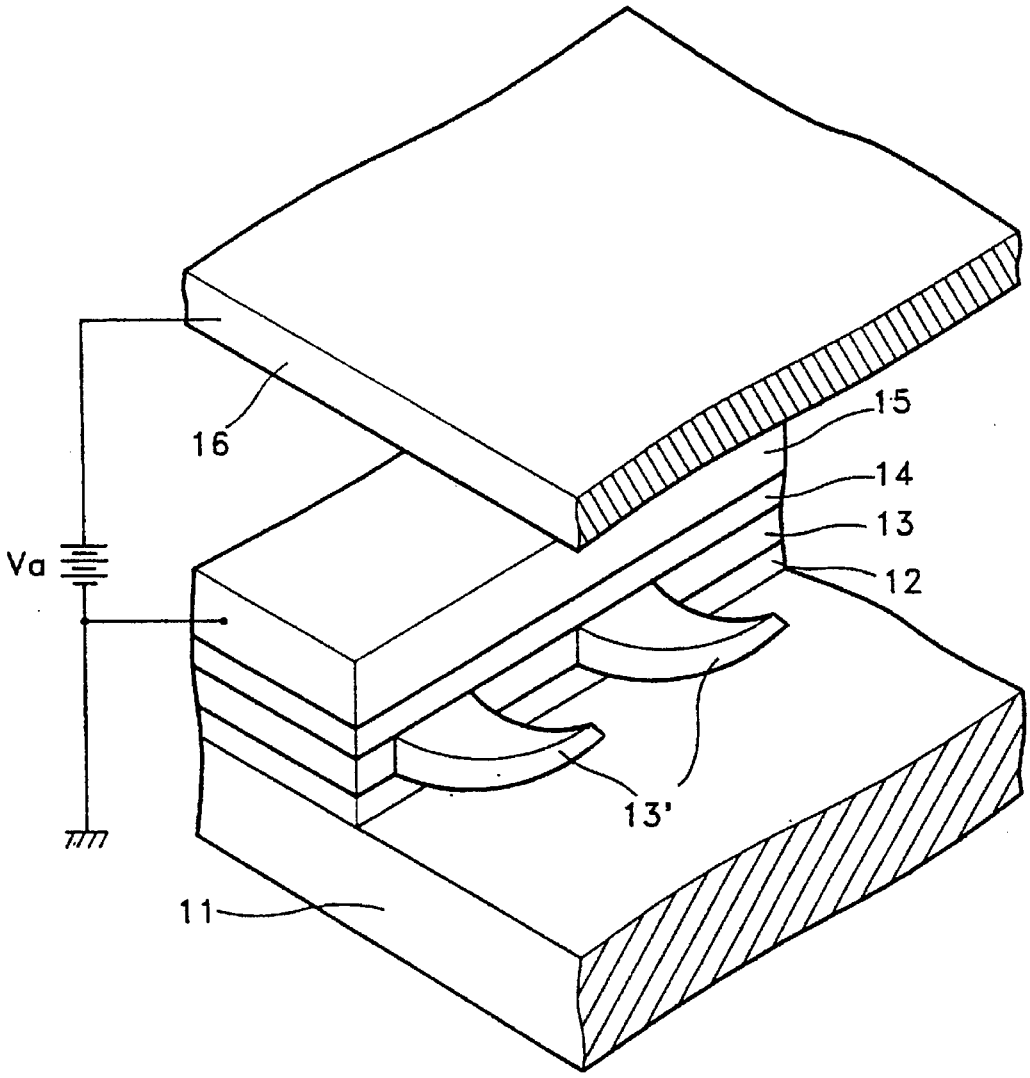
FIG. 5 is a perspective view illustrating a method for driving the field emission micro-tip according to the present invention.

In the field emission micro-tip having the aforementioned structure, an anode 16 is provided thereabove as shown in FIG. 5. The edges of the structure are sealed and the space beneath the anode 16 which is maintained by spacers is made into a vacuum having a pressure below $10^{-6}$ torr. If the cathode supporting layer 15 is grounded and then a predetermined power voltage is applied to the anode 16, a strong electrical field is formed, such that electrons are emitted from the micro-tip 13'.

In such a structure, multiple tips of an array shape has an advantage in that the output current can be manipulated in a wide range from nanoamperes to miliamperes. Also, since tungsten is used for fabricating the micro-tips, excellent properties are obtained with regard to strength, oxidation, work function, and electrical, chemical and mechanical durability. Therefore, the field emission micro-tip having the above-described structure can be used as a flat panel display, a high-power microwave device, an electron-beam-applied scanning electron microscope, a device for a electron-beam-applied system or a multiple beam emission pressure sensor.

The method for fabricating the field emission micro-tip having the aforementioned structure will now be described.

First, titanium (Ti) is deposited on a glass substrate 11 to a thickness of 2,000 Å to form an adhesive layer 12. Thereafter, tungsten is deposited to a thickness of 1 μm by a DC-magnetron sputtering method to form a cathode layer 13. The cathode layer 13 has a very strong internal stress which is not evident until it is used in protruding the tip pattern of the cathode layer 13 upwardly to a very strong extent during rapid etching of the adhesive layer 12.

Aluminum (Al) is then deposited to a thickness of 1,000 Å by a DC-magnetron sputtering method or an electron-beam deposition method to form a mask layer 14. A chrome pattern is then formed as a cathode supporting layer 15. The chrome pattern is formed using a lift-off method, or by forming and patterning a chrome layer using a lithographic etching method. The chrome pattern serves to support the cathode and prevent separation from the substrate when the micro-tip 13' is protruded upwardly by the internal stress of the tungsten.

Figure 4A:
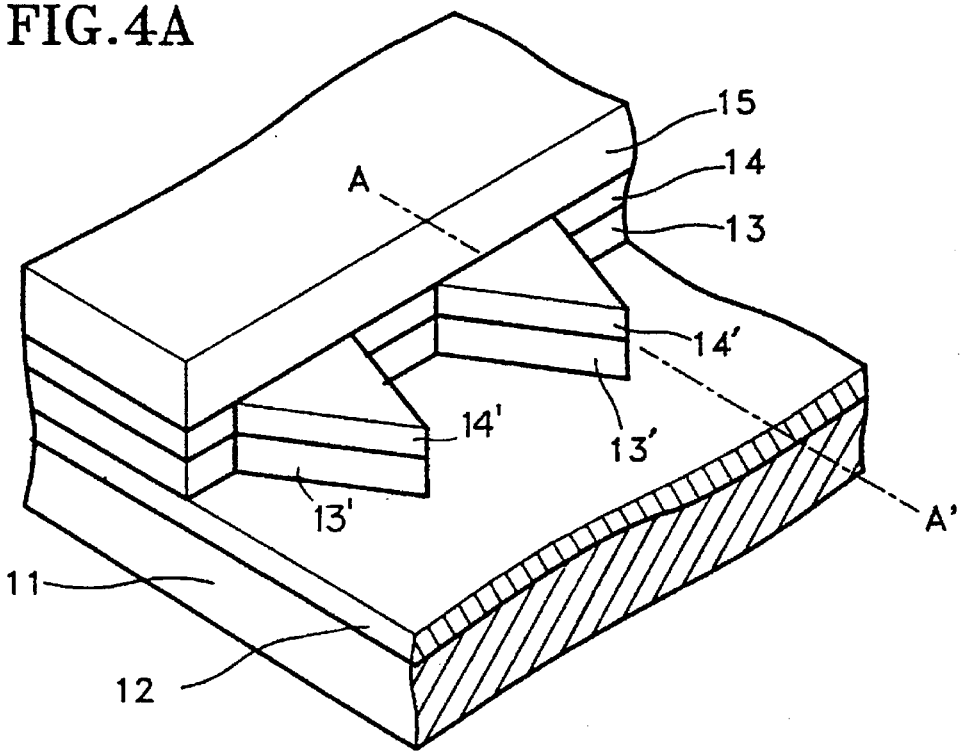
FIGS. 4A and 4B are a partly exploded perspective view and a vertical cross-section, respectively, showing the fabrication process of the field emission micro-tip shown in FIG. 3.
Figure 4B:
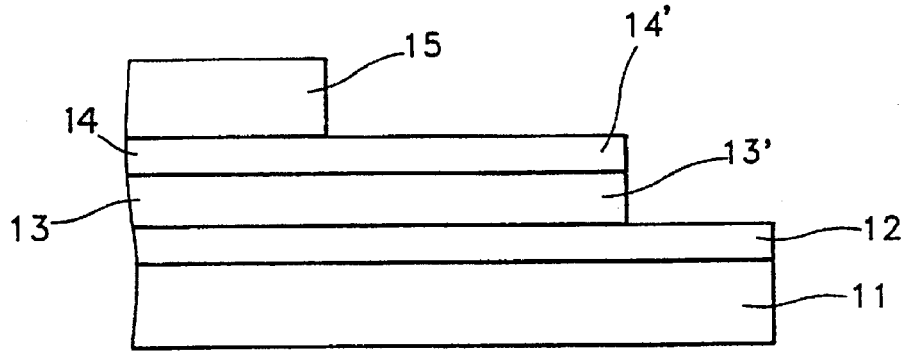

Next, Al mask layer 14 is etched by a reactive ion etching (RIE) method to form a mask 14' for fabricating the micro-tip. Here, a lift-off method may be adopted. At this time, the plane mask 14' is etched to be a sharp triangle, as shown in FIG. 4A. The sharpness of the micro-tip is determined by the patterning method of the mask. As a result, the basic structure of the field emission micro-tip shown in FIGS. 4A and 4B is completed.

Tungsten cathode layer 13 is etched by $CF_4$—$O_2$ plasma using an Al mask 14' to form a micro-tip portion 13'. Titanium adhesive layer 12 and Al mask 14' are then instantaneously etched by a buffered oxide etching (BOE) method to complete a micro-tip 13'. During BOE, when the adhesive layer 12 is instantaneously etched, the separated micro-tip portion 13' projects upwardly from the adhesive layer 12 due to the internal stress of the tungsten, thereby completing the micro-tip 13'. Since the etching rate of titanium adhesive layer 12 is very high, it is important to control the etching process which needs to be completed in a short time. The etching solution used during BOE is a mixed solution of HF and $NH_4F$ in a ratio ranging from 7 to 1 to 10 to 1.

As described above, the field emission micro-tip according to the present invention is fabricated such that when the adhesive layer and mask are instantaneously etched, the tungsten micro-tip portion lifted upwardly due to the differences in internal stress of the tungsten cathode, the lower adhesive layer and the upper mask layer. By adjusting the shape of the mask, the sharpness of the micro-tip is easily adjusted. Also, since the internal stress of tungsten and characteristics of the BOE method are utilized throughout the fabricating process, reproducibility is ensured. Moreover, since multiple tips are fabricated, the output current can be manipulated in a wide range from nanoamperes to miliamperes. Further, since tungsten is used for fabricating the micro-tips, excellent properties with regard to strength, oxidation, work function, and electrical, chemical and mechanical durability are obtained.

What is claimed is:

1. A field emission micro-tip, comprising:

a substrate;

an adhesive layer formed of a material etchable in an etching solution at a first etching rate higher than a predetermined rate, and disposed on said substrate;

a cathode formed of a metal having an internal stress greater than a value predetermined in relation to an internal stress of said adhesive layer and having a negligible etching rate in said etching solution, and disposed on said adhesive layer;

a micro-tip extending outwardly from said cathode and formed from a same material as said cathode;

a mask formed of a material etchable in said etching solution at a second etching rate lower than said first etching rate, and disposed on said cathode; and a metal pattern formed on said mask for supporting said cathode.

2. A field emission micro-tip as claimed in claim 1, wherein said adhesive layer is formed by depositing titanium to a predetermined thickness.

3. A field emission micro-tip as claimed in claim 1, wherein said adhesive layer is formed by depositing aluminum to a predetermined thickness.

4. A field emission micro-tip as claimed in claim 1, wherein said cathode is formed by depositing tungsten to a predetermined thickness.

5. A field emission micro-tip as claimed in claim 1, wherein said micro-tip has a generally triangular shape and a predetermined upwardly protruded angle.

6. A field emission micro-tip as claimed in claim 5, wherein said predetermined upwardly protruded angle is 60° to 70°.

7. A field emission micro-tip as claimed in claim 1, wherein said mask is formed by depositing aluminum to a predetermined thickness.

8. A field emission micro-tip as claimed in claim 1, wherein said mask is formed by depositing titanium to a predetermined thickness.

9. A field emission micro-tip as claimed in claim 1, wherein said metal pattern is formed of chrome.

10. A field emission micro-tip as claimed in claim 1, wherein said micro-tip has a generally triangular shape whose peak is upwardly protruded.

* * * * *